US005777302A

United States Patent [19]

Nakagawa et al.

[11] Patent Number: 5,777,302

[45] Date of Patent: Jul. 7, 1998

[54] TOKEN CHUTE DEVICE

[75] Inventors: Toshiaki Nakagawa; Hideo Tsumura, both of Zama, Japan

[73] Assignee: Konami Co., Ltd., Hyogo-ken, Japan

[21] Appl. No.: 600,385

[22] Filed: Feb. 12, 1996

[30] Foreign Application Priority Data

Feb. 13, 1995 [JP] Japan ..... 7-024292

[51] Int. Cl.[6] ..... G07G 1/00; G07F 1/04

[52] U.S. Cl. ..... 235/7 A; 194/344

[58] Field of Search ..... 235/74 A; 194/344, 194/345, 346

[56] References Cited

U.S. PATENT DOCUMENTS

| | | | |
|---|---|---|---|
| 4,462,414 | 7/1984 | Gordon . | |
| 4,800,997 | 1/1989 | Oezeki et al. | 194/344 |
| 4,947,995 | 8/1990 | Eguchi . | |

FOREIGN PATENT DOCUMENTS

| | | |
|---|---|---|
| B6852087 | 9/1987 | Austria . |
| 2116234 | 10/1972 | Germany . |
| 1147468 | 10/1989 | Japan . |

OTHER PUBLICATIONS

Japanese Unexamined Utility Model Publication No. SHO 53-108994 Feb. 4, 1977*.

Japanese Unexamined Utility Model Publication No. SHO 57-95672* Dec. 1, 1980*.

Japanese Unexamined Utility Model Publication No. SHO 61-160572* Oct. 4, 1986*.

Japanese Unexamined Utility Model Publication No. SHO 64-147468* Oct. 12, 1989*.

Japanese Unexamined Patent Publication No. HEI 2-45896*. Feb. 15, 1990*.

*Primary Examiner*—Michael L. Gellner

*Assistant Examiner*—Daniel Chapik

*Attorney, Agent, or Firm*—Jordan and Hamburg

[57] ABSTRACT

A token chute device is usable for a plurality of sizes of tokens, and includes: a main body formed with a token chute passage extending in a substantially vertical direction and having an original space width to allow a largest token among the plurality of sizes of tokens to pass; and a space width adjusting member having a width smaller than the original space width of the token chute passage, the space width adjusting, member being mountable on an inner side wall of the token chute passage to reduce the original space width of the token chute passage.

11 Claims, 6 Drawing Sheets

TOKEN CHUTE DEVICE

BACKGROUND OF THE INVENTION

This invention relates to a token chute device for use in a token-operated apparatus, such as slot machine or vending machine.

There have been various token chute devices for token-operated apparatus which is activated by insertion of a token. Such a token chute device is formed with a slot or token chute passage having a specified space width into which a token is to be dropped. In conventional token chute devices, the token chute passage is molded or defined in an one main body by dies. Accordingly, each type of token device has a fixed space width. Japanese Examined Patent Publication No. 4-50638 and Japanese Unexamined Utility Model Publication No. 1-147468 disclose such a token chute device, for example.

However, there are various kinds of tokens having different diameters. Also, various kinds of token-operated apparatus respectively use different sized acceptable tokens. In such circumstances, it has been necessary to provide the type of token chute device which is suitable for a particular token-operated apparatus, in other words, to provide a special type of token chute device corresponding to each kind of apparatus. This has been very costly.

Also, a main body of the conventional token chute devices is formed in one body. Accordingly, the conventional token chute devices requires complicated and high cost production procedures.

In slot machines, especially, there is the necessity of changing the kind of acceptable token in accordance with a change of game. In this case, conventionally, an old token chute device has been replaced in the entirety with a new token device having a different space width for a new acceptable token. This has unavoidably increased the maintenance costs of game machines.

SUMMARY OF THE INVENTION

An object of the present invention is to provide a token chute device which has overcome the problems residing in the prior art.

Another object of the present invention is to provide a token chute device which can be produced more easily and at reduced costs.

Still another object of the present invention is to provide a token chute device which is applicable for various kinds of tokens and thus reduces the production and maintenance cost of a token-operated apparatus.

According to the present invention, a token chute device is adapted for selectively chuting one of a plurality of sizes of tokens, the token chute device comprises: a main body formed with a token chute passage extending in a substantially vertical direction and having an original space width to allow a largest token among the plurality of sizes of tokens to pass; and a space width adjusting member having a width smaller than the original space width of the token chute passage, the space width adjusting member being mountable on an inner side wall of the token chute passage to reduce the original space width of the token chute passage.

The main body may be preferably constructed by a first member having a recess extending in the vertical direction and having a width equal to the original space width; and a second member separably attachable to the first member to define the token chute passage. The second member may be formed with a token stocking portion for stocking a plurality of tokens, the token stocking portion extending along a direction intersecting a vertical plane passing the token chute passage. The token stocking portion may be provided with a trough having a width equal to or larger than the diameter of the largest token for accommodating a plurality of tokens, an axis of the trough being inclined upward as approaching to the token chute passage. Also, the token stocking portion may be provided with a trough having a width equal to or larger than the diameter of the largest token for accommodating a plurality of tokens, the trough being formed with a groove in a bottom thereof, the groove extending in parallel with an axis of the trough.

It may be appreciated that the space width adjusting member is formed with a slopped top surface.

Further, it may be appreciated to provide a plurality of space width adjusting members having different widths from one another.

With the token chute device, there is a space width adjusting member to adjust the space width of the token chute passage. The space width of the token chute passage is changed by mounting or demounting a suitable space width adjusting member in the original chute passage. Accordingly, it is not necessary to entirely produce a token chute device suitable for each size of acceptable token, which will thus reduce the production costs and maintenance costs of token-operated apparatus remarkably.

Also, the main body is made up by the first member having the vertical recess and the second member separably attachable to the first member. In other words, the main body is constructed by separable members. Accordingly, the construction of the token chute device can be performed more easily and at a reduced cost.

The token stocking portion is formed in the second member. The token stocking portion is formed with the trough. The trough is inclined upward as approaching to the chute passage. This will ensure stable stocking of a plurality of tokens. Also, the groove is formed in a bottom of the trough, thereby assuring stable stocking of smaller tokens.

The space width adjusting member is formed with a slope on a top surface thereof. Accordingly, a token can be dropped into the chute passage more smoothly and reliably.

Further, there are a plurality of space width adjusting members having different widths. Accordingly, an increased number of space widths can be provided for the token chute passage.

The above and other objects, features and advantages of the present invention will become more apparent upon a reading of the following detailed description and drawings.

BRIEF DESCRIPTION OF THE DRAWINGS

FIG. 4A is a partial cross sectional view of the trough and the groove at the bottom of the trough;

DETAILED DESCRIPTION OF THE PREFERRED EMBODIMENTS OF THE INVENTION

An embodiment of the present invention will be described with reference to the accompanying drawings. In this embodiment, a token chute device is mounted on a slot machine G. However, it should be appreciated that a token chute device of the present invention can be used for other token-operated apparatus, e.g., for vending machine.

Figure 8:
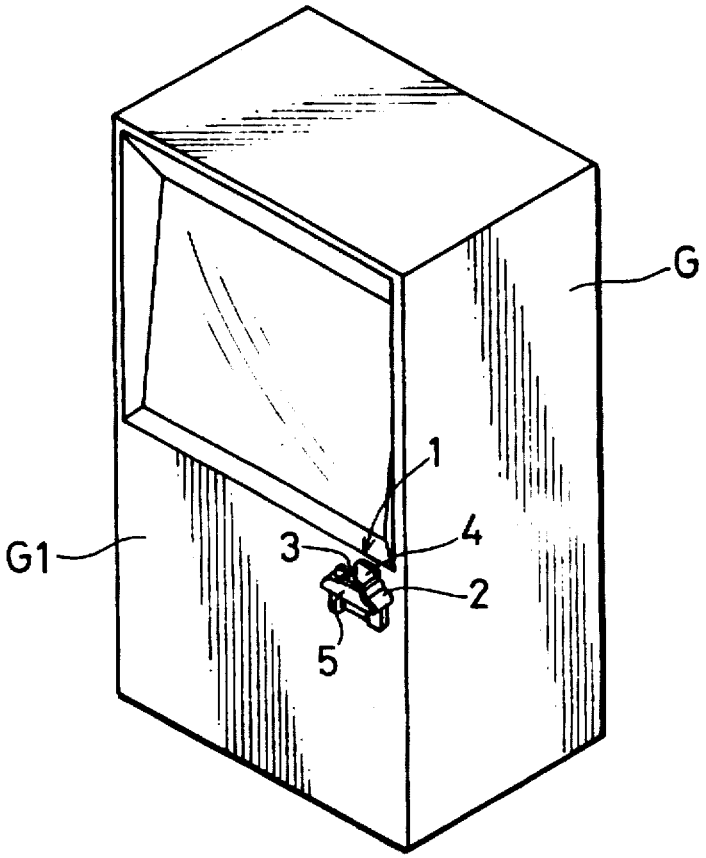
FIG. 8 is a perspective view of a game machine provided with the token chute device.

Indicated at 1 is a token chute device essentially consisting of a base member 2, a rear plate member 4 and a front plate member 5. The base member 2 and the rear plate member 4 forms a main body of the token chute device. These members are separable from one another. The base member 2 is fixedly secured to a front board GI of a slot machine G as shown in FIG. 8. A token stocking portion 3 is formed in an intermediate of the base member 2 to store a desired number of tokens C. The rear plate member 4 is disposed on a rear end of the token stocking portion 3. The front plate member 5 is disposed on a front end of the token stocking portion 3. Further, a jam removing button 6 is provided in a left side of the base member 2. A top portion of the button 6 is projected from the base member 2 by a specified height.

The base member 2 has a rear support portion 21 extending downward. When viewed from right or left side, the base member 2 takes an L-shape in its entirety. Specifically, the connection of the token stocking portion 3 and the rear support portion 21 forms the L-shape. The rear support portion 21 is formed with oblong holes 22 at appropriate positions thereof. The oblong hole 22 vertically extends by a specified length. By fitting an unillustrated screw through the oblong hole 22 and an unillustrated threaded hole formed at a specified position in the front board GI of the slot machine G, the base member 2 is fixedly attached to the front board GI of the slot machine G.

Figure 1:
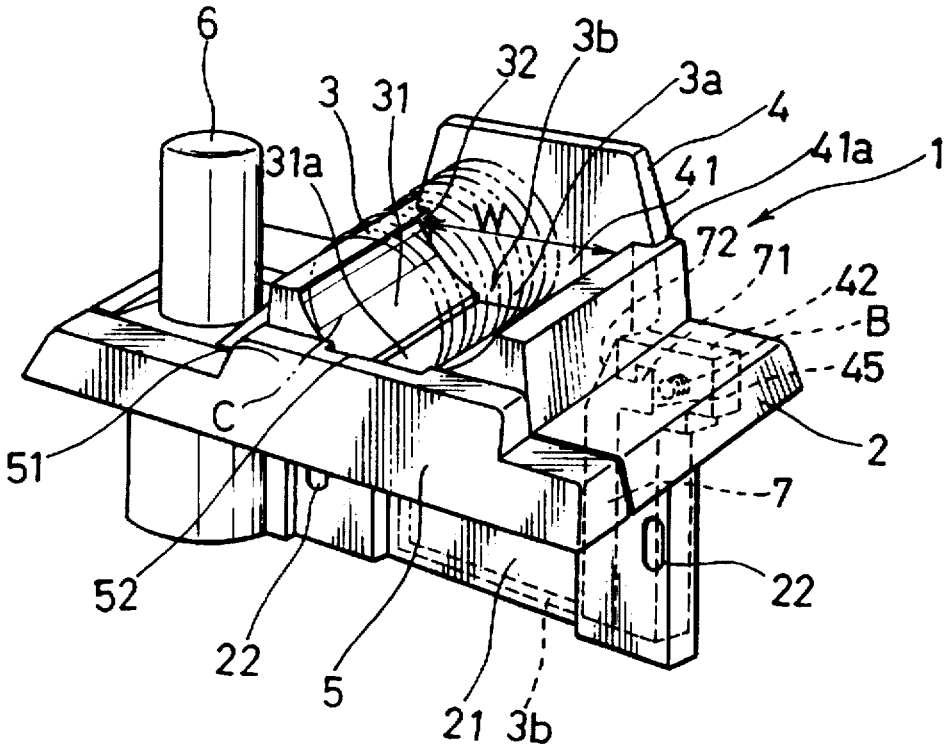
FIG. 1 is a perspective view of a token chute device embodying the present invention.
Figure 2:
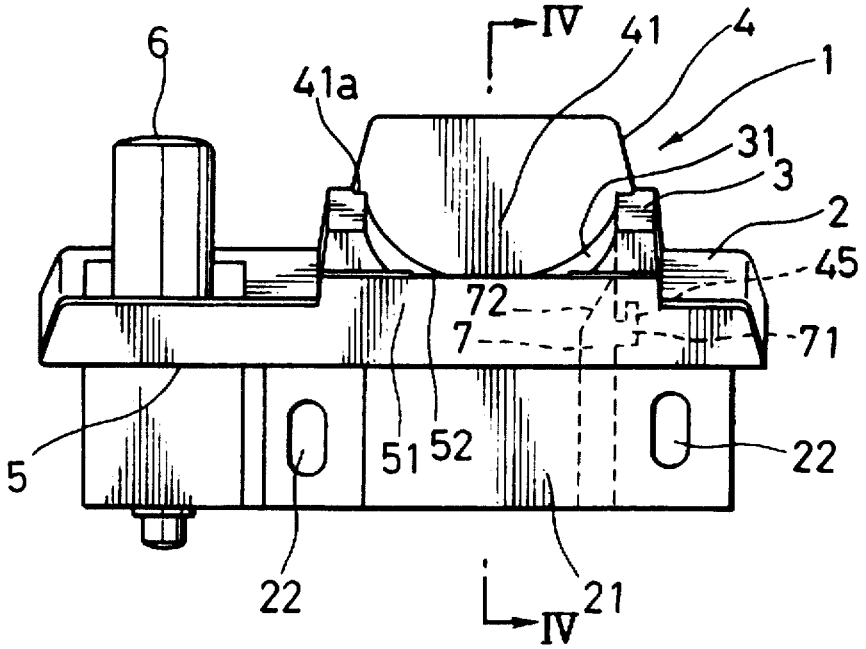
FIG. 2 is a front view of the token chute device.
Figure 3:
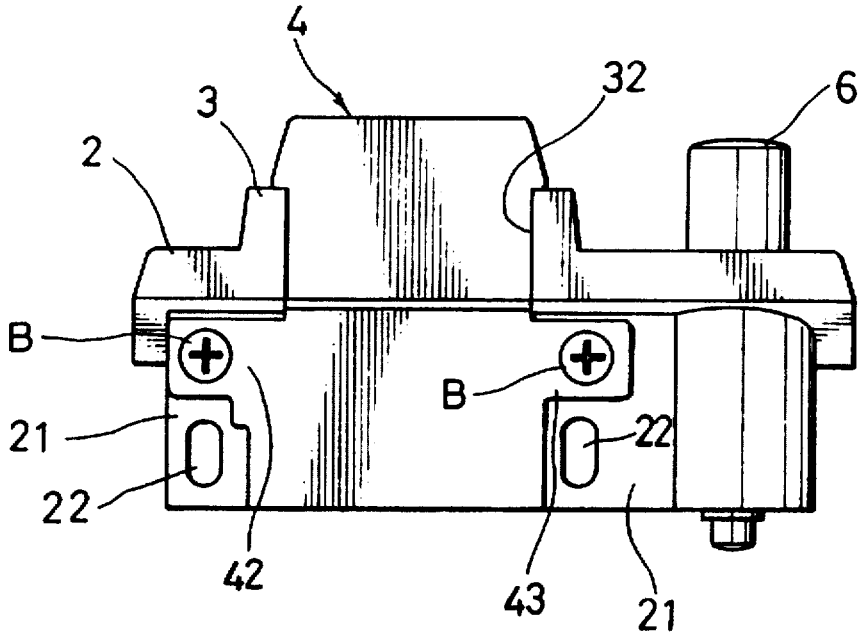
FIG. 3 is a rear view of the token chute device.
Figure 4:
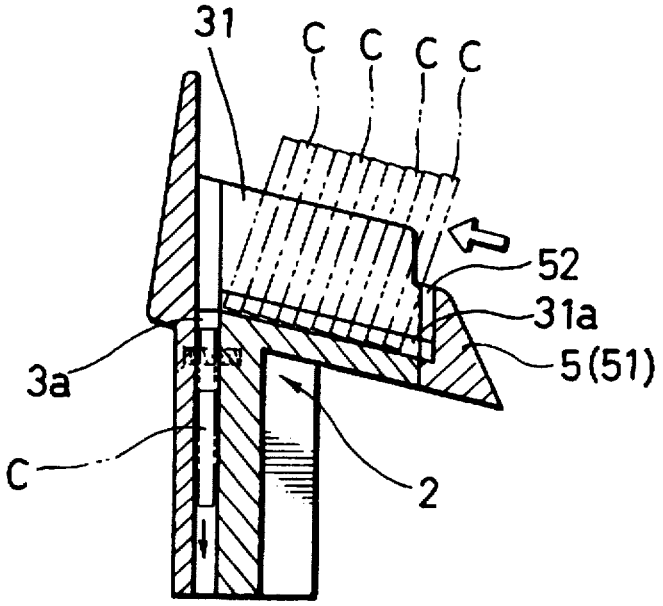
FIG. 4 is a cross sectional view taken along the line IV—IV in FIG. 2.

The token stocking portion 3 has a trough 31 formed in a top surface of the base member 2. The trough 31 has a curved shape in the form of an arc when viewed from front end and extends from front to rear. The curvature of the trough 3 1 is made to be larger than the curvature of a token C having a largest diameter. A desired number of tokens C are placed in the trough 31 in an upright posture one after another. As shown in FIG. 4, an axis of the trough 31 is inclined upward at a specified angle as approaching to the rear end. This inclination allows the row of tokens C placed in the trough 31 to lean forward.

In this embodiment, the axis of the trough 31 is inclined upward when approaching to the rear end. However, the axis of the trough 31 may be parallel with a horizontal plane. Also, the axis of the trough 31 may be inclined downward when approaching to the rear end. In this case, however, a small projection may be preferably formed at a rear end of the trough 31 to temporarily keep a leading token C from inadvertently falling off.

Also, the base member 2 is formed with a recess 32 in a rear surface thereof. The recess 32 generally has a cross shape corresponding to the shape of the rear plate member 4. The rear plate member 4 comes in the recess 32 when combining the base member 2 and the rear plate member 4 as mentioned later.

Figure 5:
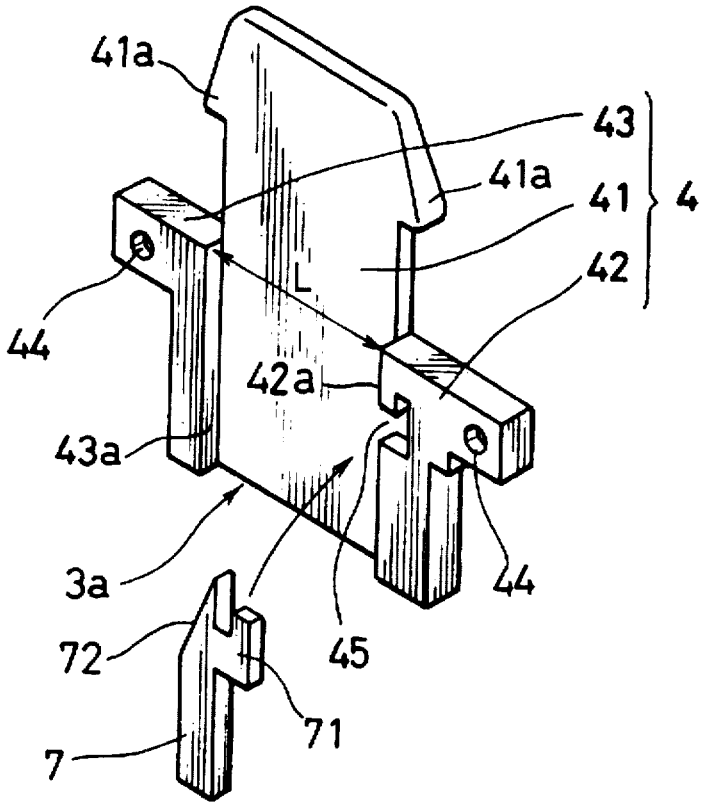
FIG. 5 is a perspective view of a rear plate member of the token chute device, a space width adjusting member being not mounted on the rear plate member.

As shown in FIG. 5, the rear plate member 4 includes a main portion 41 and widthwise portions 42 and 43 extending from the main portion 41 in the opposite side directions. The main portion 41 is formed with shoulder projections **41*a* on both top side ends thereof. The shoulder projections 41*a* and the side portions 42 and 43 combinedly define engagement spaces in which rear projecting portions of the base member 2** is to be fitted.

The side portions 42 and 43 of the rear plate member 4 are made to protrude forward from the front surface of the rear plate member 4 by a specified depth to form inner walls **42*a* and 43*a* to form a cavity. Also, the side portions 42 and 43 are formed with holes 44 at appropriate positions thereof. The rear plate member 4 is fixedly attached to the base member 2 by screws passing through the holes 44. In the state that the base member 2 and the rear plate member 4 are combined with each other, as shown in FIG. 4, a token chute passage 3*a* is defined by a front surface of the cavity formed in the rear plate member 4, a rear surface of the rear support portion 21, and the inner walls 42*a* and 43*a* of the cavity formed in the rear plate member 4. The gap between the front surface of the cavity formed in the rear plate member 4 and the rear surface of the rear support portion 21** is slightly larger than the thickness of a token C.

Further, the inner wall **42*a* of the side portion 42 is formed with a holding hole 45 for holding a space width adjusting member 7 as described later. The holding hole 45** has a substantially L-shape when viewed from the front.

The front plate member 5 is formed with a token restricting portion 51 which is projected upward. The token restricting portion 5 1 prevents tokens C from falling off from the trough 31. The token restricting portion 51 is formed with a recess 52 in a rear surface thereof. The recess 52 provides a gap between a token C and the front plate member 5 to ensure easier handling of tokens C.

At a left side of the base member 2 is provided a jam removing button 6 for removing a jam state oftokens in a token collector provided in the slot machine G. The jam removing button 6 is operatively connected with an unillustrated removing mechanism near the token collector. The jam removing button 6 is moved downward to actuate the removing mechanism to thereby remove the jam state.

The trough 31 is formed with a groove **31*a* at a bottom surface thereof. The groove 3*a* extends over the length of the trough 31 so that a lower circumferential portion of the token C placed in the trough 31 abuts against upper edges 31*b*, 31*c* of the groove 31*a*. Accordingly, the groove 31*a* stably holds even tokens having a curvature greater than that of the trough 31, that is, having a diameter smaller than the width W of the trough 31. Accordingly, when a desired number of tokens in a row are pushed to the rear end, each token C placed in the trough 31 can be prevented from being displaced in sideways, and can be moved to the token chute passage 3*a* one after another while guided along the groove 31*a*. Accordingly, tokens C of a smaller diameter can be reliably guided to the token chute passage 3*a***.

Tokens C are inserted into the slot machine G as follows. The player nips a desired number of tokens with fingers, placing the number of tokens C in the trough 31 of the token stocking portion 3, and pushing the token row to the rear plate member 4 with a finger. Consequently, moved tokens C sequentially drop through the token chute passage **3*a*** to the unillustrated token collector provided in the slot machine G.

Figure 6:
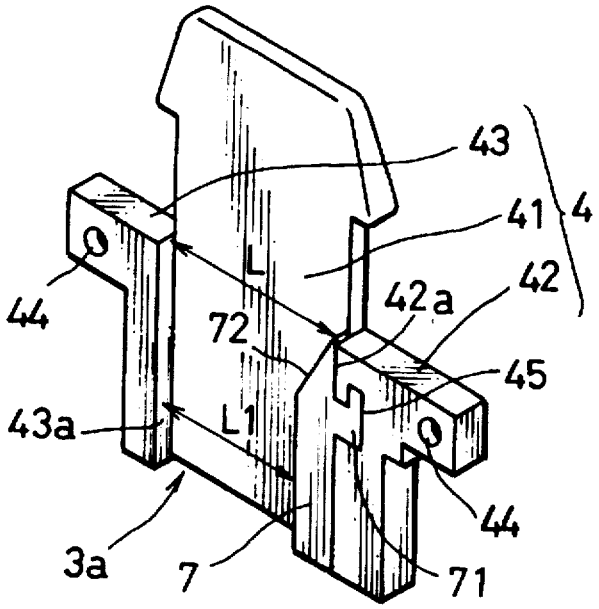
FIG. 6 is another perspective view of the rear plate member, the space width adjusting member being mounted.

Next, adjustment of the space width of the token chute passage 3a will be described with reference to FIGS. 5 and 6. FIG. 5 is a perspective view of the rear plate member 4 showing a state that the space width adjusting member 7 is not mounted while FIG. 6 is a perspective view of the rear plate member 4 showing a state that the space width adjusting member 7 is mounted.

The space width adjusting member 7 is adapted for adjusting the space width L of the token passage 3b. The space width adjusting member 7 is in the form of a plate. The thickness of the space width adjusting member 7 is substantially identical to the gap of the token passage 3a. An outer side of the space width adjusting member 7 is substantially identical to the length of the inner wall 42a of the side portion 42. The space width adjusting member 7 is formed with an arm portion 71 on the outer side end. The arm portion 71 has an L-shape corresponding to the shape of the holding hole 45 formed in the side portion 42 so that the arm portion 71 engages with the holding hole 45. The space width adjusting member 7 has a slope 72 in an upper portion thereof. The slope 72 serves to guide a dropped token into the chute passage 3a.

The space width adjusting member 7 is fittingly mounted on the inner wall 42a of the side portion 42 by placing the arm portion 71 in the holding hole 45. Consequently, the space width of the token passage 3a is reduced to L1 which is smaller than the original width L. The space width adjusting member 4 is mounted on the side portion 42 before the rear plate member 4 is attached to the base member 2.

In the foregoing embodiment, the cavity is formed in the rear plate member 4. The token chute passage 3a is defined by covering the rear support portion 21 of the base member 2. However, according to the present invention, a cavity may be formed in a base member 2, and covered by a rear plate member 4 formed with no cavity to define a token chute passage.

In the foregoing embodiment, also, the holding hole 45 of the side portion 42 and the arm portion 71 of the space width adjusting member 7 are formed into the L-shape. However, the shape of the engaging hole and the arm portion is not limited to the L-shape, but any kind of shape such as wedge-shape or T-shape is applicable as far as the outer side of the space width adjusting member 7 can be retained to be in close contact with the inner wall 42a of the side portion 42.

Further, it may be appreciated to form a vertical hole in an upper portion of the side portion 42 and form a hanger portion on a top outer end of the space width adjusting member 7, the hanger portion engageable with the vertical hole formed in the side portion 42. With this construction, after the rear plate member 4 is attached to the base member 2, the space width adjusting member 7 can be mounted on the side portion 42 of the rear plate member 4 because the space width adjusting member 7 can be inserted into the original chute passage 3a from above.

Further, in the foregoing embodiment, the space width adjusting member 7 is mounted on the inner wall 42a of the side portion 42. However, the space width adjusting member 7 may be mounted on the inner walls 43a of the other side portion 43.

Moreover, in the foregoing embodiment, the inner side of the space width adjusting member 7 is formed with the slope 72 in the upper portion thereof. According to the present invention, however, it may be possible not to form a slope in an upper portion of the space width adjusting member 7.

Figure 7A:
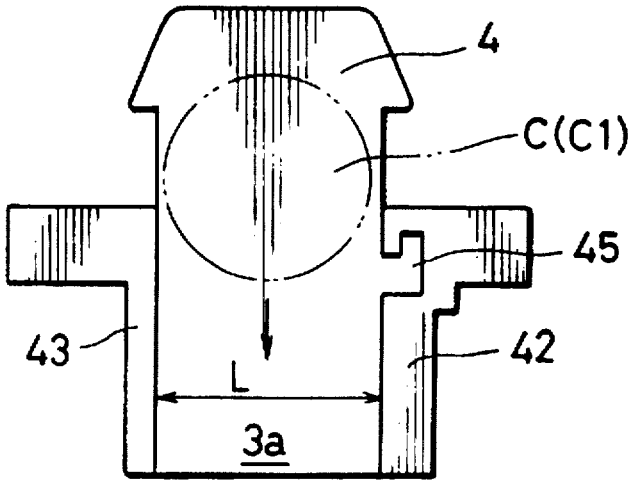
FIGS. 7A to 7B are front views of the rear plate member, FIG. 7A showing a state that no space width adjusting member is mounted, FIG. 7B showing a state that a space width adjusting member having a small width is mounted, and FIG. 7C showing a state that a space width adjusting member having a large width is mounted.
Figure 7B:
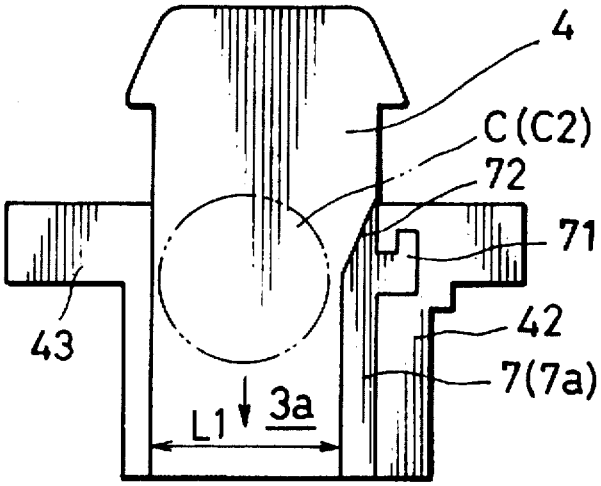
Figure 7C:
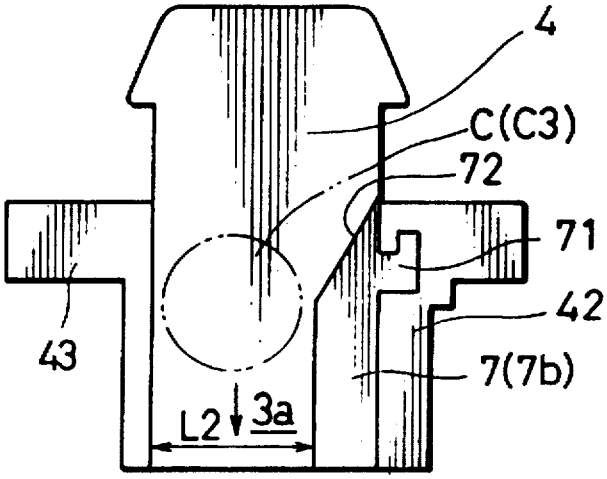

FIGS. 7A to 7C show forming of three different space widths for the token chute passage 3a, respectively. Specifically, in FIG. 7A, any space width adjusting member 7 is not mounted on the side portion 42 to thereby define a largest space width L for a token C1 having a largest diameter. In FIG. 7B, a space width adjusting member 7a having a smaller width is mounted on the side portion 42 to thereby define an intermediate space width for a token C2 having an intermediate diameter. In FIG. 7C, a space width adjusting member 7b having a larger width is mounted on the side portion 42 to thereby define a largest space width for a token C3 having a smallest diameter.

In the foregoing embodiment, the space width of the token passage 3a is adjusted by selectively mounting a space width adjusting member having an appropriate width from among a plurality of space width adjusting members having different widths. However, in place of provision of a plurality of space width adjusting member having different widths, it may be appreciated to provide a plurality number of space width adjusting members of the same type having the same width, and connect space width adjusting members of this type one on another to obtain a desired space width. This will eliminate of providing different types of space width adjusting members having different widths, thus reducing the production costs of space width adjusting members.

As mentioned above, by providing a plurality of kinds of space width adjusting members whose width is different from one another, a space width adjusting, member having a width corresponding to the size of token to be used in the slot machine G can be selected from among the plurality of kinds of space width adjusting members, and the selected space width adjusting member can be mounted on the side portion 42 easily even if the kind of token to be used with the slot machine G is changed and the diameter of token becomes different from the width L of the token passage 3b initially provided. Accordingly, there is no necessity of fabricating a plurality of kinds of token chute devices suitable to various sizes of token C which are assumed to be used in the slot machine G. The production costs of a token chute device can be reduced remarkably.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A token chute device for selectively chuting one of a plurality of sizes of tokens, the token chute device comprising:

a main body formed within a first token chute passage extending in a substantially vertical direction, said first token chute passage having first and second fixed inner side walls spaced from one another to define therebetween an original space width to allow a largest token among a plurality of sizes of tokens to pass through said first token chute passage;

a space width adjusting member having a width smaller than the original space width of the first token chute passage; and means detachably mounting said space width adjusting member on said first inner side wall of the first token chute passage such that said adjusting member along with the second inner side wall define a second token chute passage having a second space width less than said original space width to preclude said largest token from passing through said second token chute passage.

2. A token chute device for selectively chuting one of a plurality of sizes of tokens, the token chute device comprising:

a main body formed with a first token chute passage extending in a substantially vertical direction, said first token chute passage having first and second fixed inner walls spaced from one another to define therebetween an original space width to allow a largest size token among a plurality of sizes of tokens to pass through said first token chute passage;

a space width adjusting member having a width smaller than the original space width of the first token chute passage, the space width adjusting member including a main portion having first and second spaced sides generally parallel to one another; and means detachably mounting said space width adjusting member on the first token chute passage so that said first side of said space width adjusting member abuts said first inner wall of said first token chute passage to thereby form a second token chute passage having a second space width less than the original space width between said second side of said space width adjusting member and said second inner wall of said first token chute passage.

3. A token chute device as defined in claim 2, wherein:

the space adjusting width member includes an arm portion;

the first token chute passage including a holding hole;

the space width adjusting member being mounted on the first inner wall by placing the arm portion in the holding hole.

4. A token chute device according to claim 2 wherein said main portion of said space width adjusting member has a generally rectangular configuration.

5. A token chute device according to claim 2 wherein said main portion of said space width adjusting member has a generally polygonal configuration.

6. A token chute device according to claim 2 wherein said main portion of said space width adjusting member has an upper section disposed at an acute angle relative to said spaced parallel sides.

7. A token chute device for selectively chuting one of a plurality of sizes of tokens, the token chute device comprising:

a main body formed with a token chute passage extending in a substantially vertical direction and having an original space width to allow a largest size token among a plurality of sizes of tokens to pass;

a space width adjusting member having a width smaller than the original space width of the token chute passage, the space width adjusting member being mountable on an inner side wall of the token chute passage to reduce the original space width of the token chute passage;

said main body including a first member having a recess extending in the vertical direction and having a width equal to the original space width;

a second member separably attachable to the first member to define the token chute passage;

said second member being formed with a token stocking portion for stocking a plurality of tokens, the token stocking portion having an axis extending in a direction which intersects a vertical plane extending along the token chute passage;

said token stocking portion including a trough having a width equal to or larger than the diameter of the largest token for accommodating a plurality of tokens, the trough being formed with a groove in a bottom thereof, said groove having an axis extending parallel to the axis of the trough.

8. A token stocking device for stocking tokens of a different size and which are to be fed to a token chute, comprising an elongated trough having a longitudinal axis and a width perpendicular to said longitudinal axis, said width being substantially equal to at least the width of the largest diameter token to be stacked in said trough, said elongated trough having a bottom portion, and an elongated groove disposed in said bottom portion of said trough and having an elongate axis substantially parallel to said longitudinal axis of said elongated trough, said elongated groove having spaced upper edges which are engaged by tokens in said trough having a diameter less than said largest diameter token to thereby stably support and guide the last said smaller diameter tokens in said trough.

9. A token stocking device for stocking tokens of a different size and which are to be fed to a token chute, comprising an elongated trough having a longitudinal axis and a width perpendicular to said longitudinal axis, said width being substantially equal to at least the width of the largest diameter token to be stacked in said trough, said elongated trough having a bottom portion, and an elongated groove centrally disposed in said bottom portion of said trough and having an elongate central axis substantially parallel to said longitudinal axis of said trough, said elongated groove having spaced upper edges which are engaged by tokens in said trough having a diameter less than said largest diameter token to thereby stably support the last said smaller diameter tokens centrally in said trough with the center of the last said smaller diameter tokens being generally vertically aligned with said longitudinal axis of said trough.

10. A method of selectively chuting a plurality of sizes of tokens for a token chute device comprising:

providing an original token chute having an original space width allowing passage of a first size token, said first size token being the largest size token among a plurality of different size tokens;

detachably mounting a space width adjusting member having a width smaller than said original space width of said original token chute to reduce the original space width in said original token chute and thereby preventing passing of said first size token through said reduced spaced width while permitting the second size token smaller than said first size token to pass through said reduced width chute; and selectively operating the token chute by utilizing said first tokens by detaching said space width adjusting member from said original token chute and utilizing said second size tokens by mounting said width adjusting member in said original token chute.

11. A method of selectively chuting a plurality of sizes of tokens for a token chute device comprising:

providing a token chute having a first space width allowing passage of a first token having a first diameter, said first token having the largest diameter among a plurality of different diameter tokens;

detachably mounting a space width adjusting member having a width smaller than said first space width to reduce the first space width in said token chute to a reduced spaced width and thereby preventing said first token having said first diameter from passing through said reduced spaced width while permitting a second size token having a diameter smaller than the diameter of said first token to pass through said reduced width chute; and selectively operating the token chute utilizing said first token by detaching said space width adjusting member from said token chute and utilizing said second token by mounting said space width adjusting member in said token chute.

* * * * *